US008844859B2

(12) United States Patent
Deonarine

(10) Patent No.: US 8,844,859 B2
(45) Date of Patent: Sep. 30, 2014

(54) EXPANDABLE CHUCK FOR THERMAL PRINTING RIBBON REEL

(75) Inventor: Indarjit Deonarine, Schaumburg, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 269 days.

(21) Appl. No.: 13/397,587

(22) Filed: Feb. 15, 2012

(65) Prior Publication Data

US 2012/0280077 A1 Nov. 8, 2012

Related U.S. Application Data

(60) Provisional application No. 61/481,674, filed on May 2, 2011.

(51) Int. Cl.
*B65H 75/24* (2006.01)
*B41J 33/00* (2006.01)

(52) U.S. Cl.
CPC ..... *B41J 33/003* (2013.01); *B65H 75/245* (2013.01); *B65H 2701/372* (2013.01)
USPC ..... 242/573.2; 242/571.8; 242/573.5; 242/573.8

(58) Field of Classification Search
CPC .... B65H 75/24; B65H 75/242; B65H 75/247; B65H 16/04; B65H 54/543
USPC ..... 242/571.3, 0.6–0.8, 573, 573.1–573.2, 242/0.5, 0.7–0.8
See application file for complete search history.

(56) References Cited

U.S. PATENT DOCUMENTS

| | | | | | |
|---|---|---|---|---|---|
| 2,280,370 | A | * | 4/1942 | Bennett | 242/573.1 |
| 3,143,308 | A | * | 8/1964 | Besnyo | 242/573.7 |
| 3,329,363 | A | * | 7/1967 | Smith | 242/571.6 |
| 3,345,006 | A | * | 10/1967 | Geen | 242/571.6 |
| 3,552,673 | A | * | 1/1971 | Evers | 242/571.3 |
| 3,645,466 | A | * | 2/1972 | Karlson | 242/573.7 |
| 4,067,511 | A | * | 1/1978 | Hermanns | 242/573.3 |
| 4,223,849 | A | * | 9/1980 | Schippers et al. | 242/571.6 |
| 4,241,883 | A | | 12/1980 | Benin | |

(Continued)

FOREIGN PATENT DOCUMENTS

| | | |
|---|---|---|
| DE | 102008013125 | 9/2009 |
| JP | 11 020994 | 1/1999 |
| JP | 2002 154720 | 5/2002 |
| JP | 2005 205740 | 8/2005 |

OTHER PUBLICATIONS

PCT International Search Report (Mar. 4, 2013).

(Continued)

*Primary Examiner* — Sang Kim
(74) *Attorney, Agent, or Firm* — Klintworth & Rozenblat IP LLC

(57) ABSTRACT

A reel-to-reel assembly is provided. The reel-to-reel assembly includes, but is not limited to a supply spindle and a wind-up spindle. The supply spindle receives a supply reel having a length of ribbon wrapped around the supply reel. The wind-up spindle receives an initially empty wind-up reel. The wind-up spindle includes an adjustment mechanism for varying the outer diameter $D_O$ of the wind-up spindle from an initial outer diameter $D_{Oi}$ to a final outer diameter $D_{Of}$ which is larger than the initial outer diameter $D_{Oi}$.

14 Claims, 8 Drawing Sheets

(56) References Cited

U.S. PATENT DOCUMENTS

| | | | | |
|---|---|---|---|---|
| 4,429,838 | A * | 2/1984 | Lenk et al. | 242/573.7 |
| 5,993,092 | A | 11/1999 | Palmer | |
| 7,128,291 | B1 | 10/2006 | Schanke et al. | |
| 2002/0121570 | A1 * | 9/2002 | Yermal | 242/530.3 |
| 2008/0279603 | A1 | 11/2008 | Chen | |

OTHER PUBLICATIONS

Carr Lane Manufacturing Co.; "Alignment Pins, Expanding Pins; Cam Handle"; carrlane.com Feb. 14, 2012.

Carr Lane Manufacturing Co.; "Alignment Pins, Expanding Pins; Hex Head", carrlane.com Feb. 14, 2012.

* cited by examiner

EXPANDABLE CHUCK FOR THERMAL PRINTING RIBBON REEL

CROSS REFERENCES TO RELATED APPLICATIONS

The Present Application is based on and claims the benefit of priority from U.S. Provisional Patent Application Ser. No. 61/481,674, entitled "EXPANDABLE CHUCK FOR THERMAL PRINTING RIBBON REEL" and filed on May 2, 2011 with the United States Patent and Trademark Office, the contents of which are hereby incorporated by reference in their entirety to the extent permitted by law.

BACKGROUND OF THE INVENTION

Certain applications require use of a thermal transfer printer (TTP), which is a printer that prints on paper, or some other substrate or material, by melting a dried coating of pre-applied ink on a carrier ribbon such that the coating adheres to the substrate being printed upon. TTPs often use electronic print heads with microscopic heating elements which allow for the heating of discrete portions of the ribbon as the ribbon is moved across the print heads, melting only the coating where heat is applied on the discrete portions of the ribbon, and then transferring that coating onto the substrate. Fresh ribbon is typically wrapped around a first cylindrical core of a supply reel, and then is transferred to and wound around a second cylindrical core of a wind-up reel using a series of spindles, guides, and motors.

In one known TTP, the supply reel is mounted onto a supply spindle, the ribbon is threaded through a series of guides and a tensioner, leading to a wind-up reel which is mounted onto a wind-up spindle. The wind-up spindle is connected to a motor, through a belt and a meter roller, and the spent ribbon is wound up around the wind-up reel.

Once the coating is transferred from ribbon onto the substrate, the ribbon is considered spent and as a result, is wound up around the wind-up reel. The wind-up reel may be driven by the metering roller which may be connected with the wind-up spindle via a rubber band, or polyurethane belt, that goes around both the wind-up spindle and the metering roller in a slip drive configuration. Preferably, the gearing between the metering roller and the wind-up spindle is such that one revolution of the metering roller causes more than one revolution of the wind-up reel.

In one know arrangement, the ribbon is wrapped around the metering roller and then onto the wind-up reel. In this configuration, the wind-up reel has a paper-based cylindrical core have an inner diameter $D_I$ of approximately 25 mm, ±5 mm. The wall of the cylindrical core is approximately 3 mm, ±2 mm, thick. With reference to FIG. 1, in a traditional wind-up spindle 200, there is often found a friction fitting 202, such as a compression spring, on the wind-up spindle 200 which applies a certain amount of force onto the cylindrical core in order to secure the cylindrical core on the wind-up spindle 200.

Often times the cylindrical cores are not new, and they may be sitting around for some time, gathering humidity, possibly causing their structure to weaken. New supply reels may have as much as 600 meters to 1000 meters of ribbon on them. The ribbon is roughly 30 microns thick, ±10 microns, and is often polyester based, with a heat transferrable coating applied onto the ribbon.

As the ribbon is wound up around the wind-up reel, and specifically the cylindrical core of the wind-up reel, the ribbon tends to wrap itself tighter and tighter around the paper-based cylindrical core. As the diameter of ribbon around the cylindrical core of the wind-up reel grows in size, the tension along the ribbon and around the cylindrical core of the wind-up reel is always changing, and often increasing.

The increasing tension around the around the cylindrical core of the wind-up reel produces an inwardly radial force towards the center of the cylindrical core of the wind-up reel. As a result, many times the tension around the cylindrical core of the wind-up reel is so high that the paper-based cylindrical core of the wind-up reel collapses into itself and around the wind-up spindle, since the cylindrical core of the wind-up reel cannot withstand the high tensions and forces around it. Once the paper-based cylindrical core of the wind-up reel collapses into itself and fuses itself around the wind-up spindle, it becomes very difficult for an operator to remove the collapsed cylindrical core of the wind-up reel from the wind-up spindle. As a result, an operator may have to damage the TTP in order to remove the collapsed cylindrical core from the wind-up spindle, and possibly cause injury to the operator himself/herself in the process. Additionally, removing a collapsed cylindrical core from a wind-up spindle may also cause a significant amount of downtime for the TTP, leading to a loss of manufacturing efficiency.

It would therefore be desirable to have a device and/or method for preventing a cylindrical core of a wind-up reel from collapses into itself and fuses itself around the wind-up spindle.

SUMMARY

The present invention is defined by the following claims, and nothing in this section should be taken as a limitation on those claims.

In one aspect, a reel-to-reel assembly is provided. The reel-to-reel assembly includes, but is not limited to a supply spindle and a wind-up spindle. The supply spindle receives a supply reel having a length of ribbon wrapped around the supply reel. The wind-up spindle receives an initially empty wind-up reel. The wind-up spindle includes an adjustment mechanism for varying the outer diameter $D_O$ of the wind-up spindle from an initial outer diameter $D_{Oi}$ to a final outer diameter $D_{Of}$ which is larger than the initial outer diameter $D_{Oi}$.

In one aspect, a spindle is provided. The spindle includes, but is not limited to, a bearing, a central shaft connected with the bearing, and an adjustment mechanism connected with the central shaft. The bearing allows the central shaft to rotate axially. The adjustment mechanism varies an outer diameter $D_O$ of the spindle from an initial outer diameter $D_{Oi}$ to a final outer diameter $D_{Of}$ which is larger than the initial outer diameter $D_{Oi}$.

In one aspect, a spindle for a reel-to-reel assembly is provided. The spindle includes, but is not limited to a central shaft, an outer mandrel which is rotatably connected with the central shaft, and an adjustment mechanism connected with the outer mandrel. The central shaft is fixedly connected with a mounting plate. The adjustment mechanism varies an outer diameter $D_O$ of the spindle from an initial outer diameter $D_{Oi}$ to a final outer diameter $D_{Of}$ which is larger than the initial outer diameter $D_{Oi}$.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Methods and devices consistent with the present invention overcome the disadvantages of conventional TTPs by using a cassette assembly having a wind-up spindle with an adjustment mechanism for varying an outer diameter $D_O$ of the wind-up spindle from an initial outer diameter $D_{Oi}$ to a final outer diameter $D_{Of}$ which is larger than the initial outer diameter $D_{Oi}$. By using such an adjustment mechanism, then an outer diameter $D_O$ of the wind-up spindle can be made larger in order to accommodate a cylindrical core of a wind-up reel, and then adjusted to be made smaller in case the cylindrical core of the wind-up reel collapses onto itself and fuses itself around the wind-up spindle. By adjusting the outer diameter $D_O$ of the wind-up spindle to be made smaller, a collapsed cylindrical core can be more easily removed from the wind-up spindle.

Figure 1:
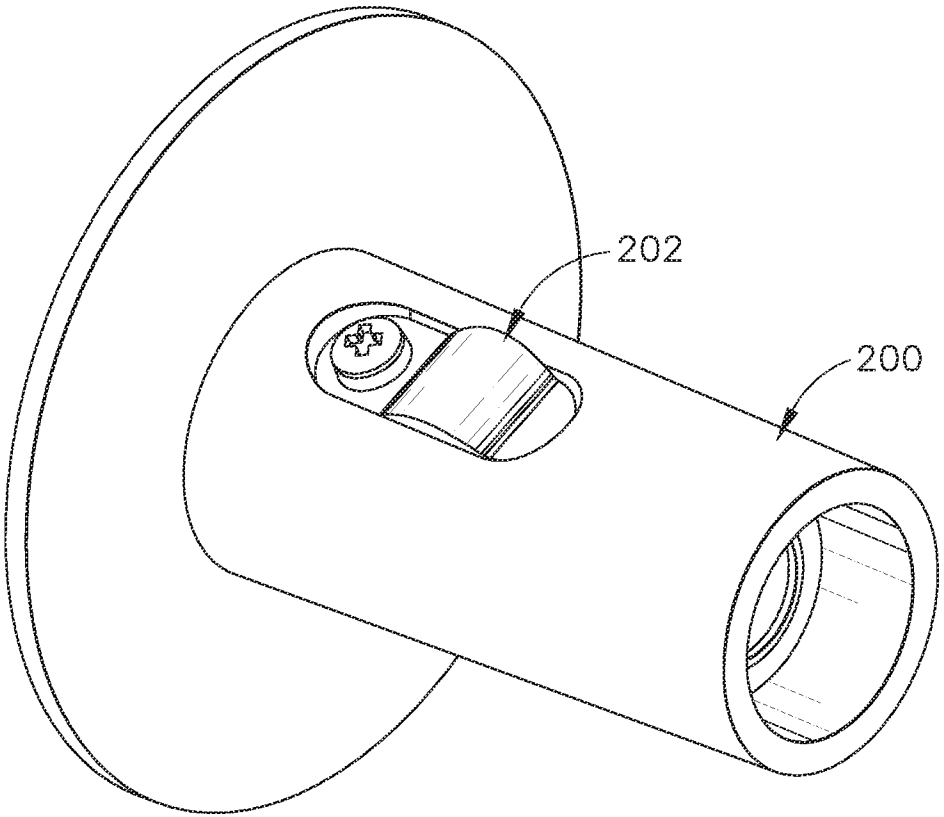
PRIOR ART Fig. 1
FIG. 1 depicts a perspective view of a traditional wind-up spindle having a friction fit on the wind-up spindle.
Figure 2:
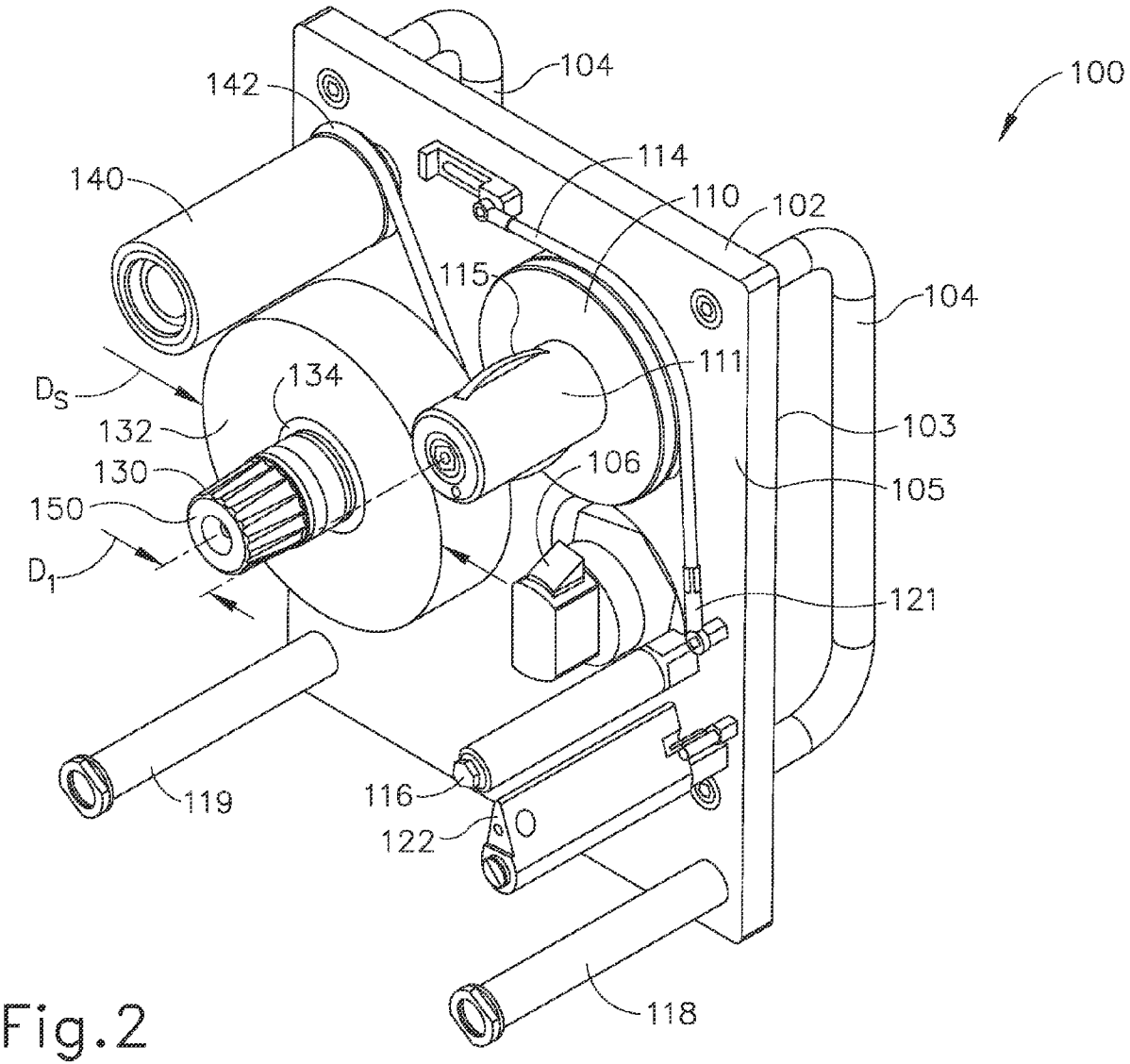
FIG. 2 depicts a first perspective view of cassette assembly for a thermal transfer printer, the cassette assembly having a supply spindle and a wind-up spindle, in accordance with one embodiment.
Figure 3:
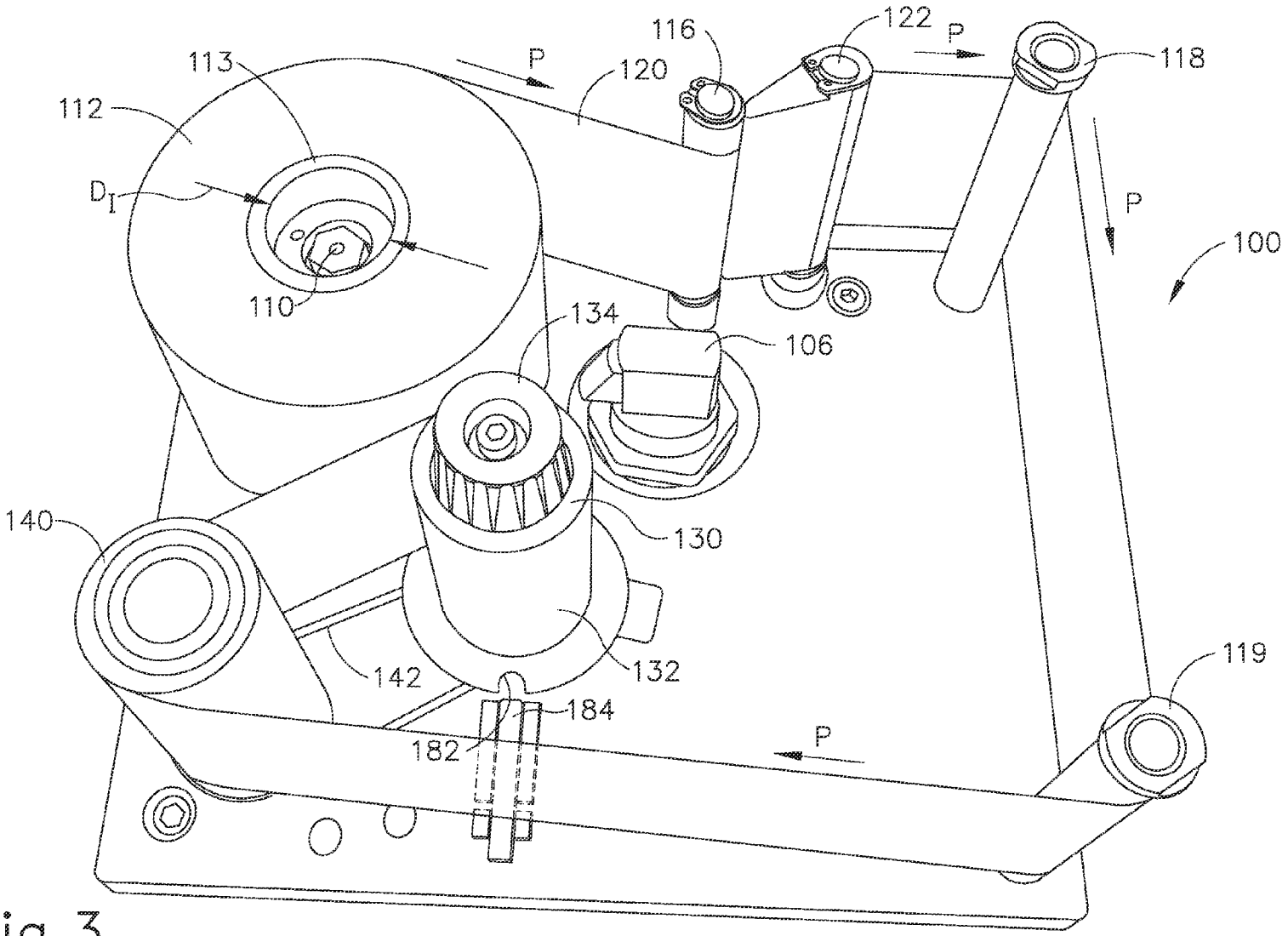
FIG. 3 depicts a second perspective view of cassette assembly for a thermal transfer printer, the cassette assembly having a supply spindle and a wind-up spindle, in accordance with one embodiment.
Figure 4:
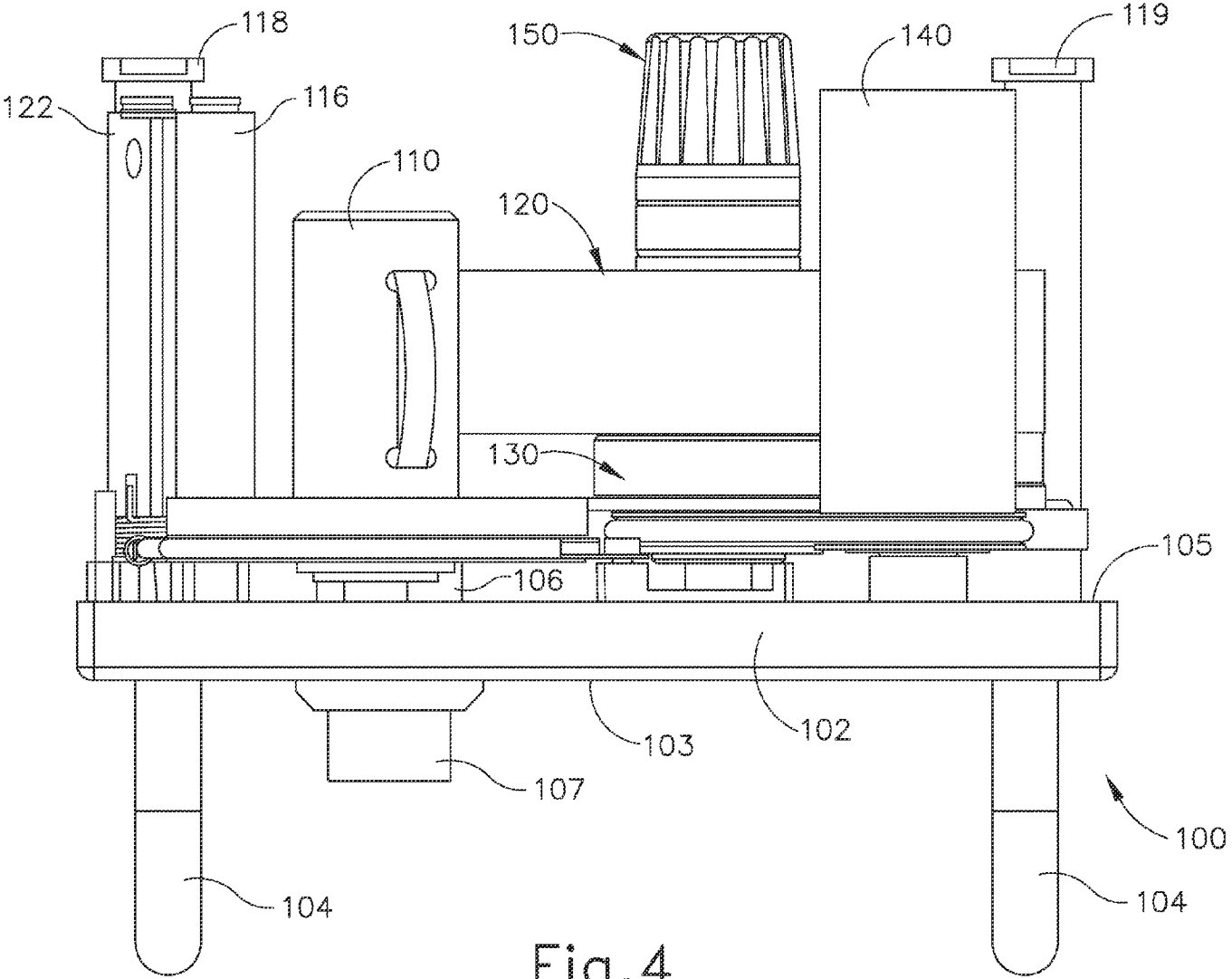
FIG. 4 depicts a side view of the cassette assembly shown in FIG. 1, in accordance with one embodiment.
Figure 5:
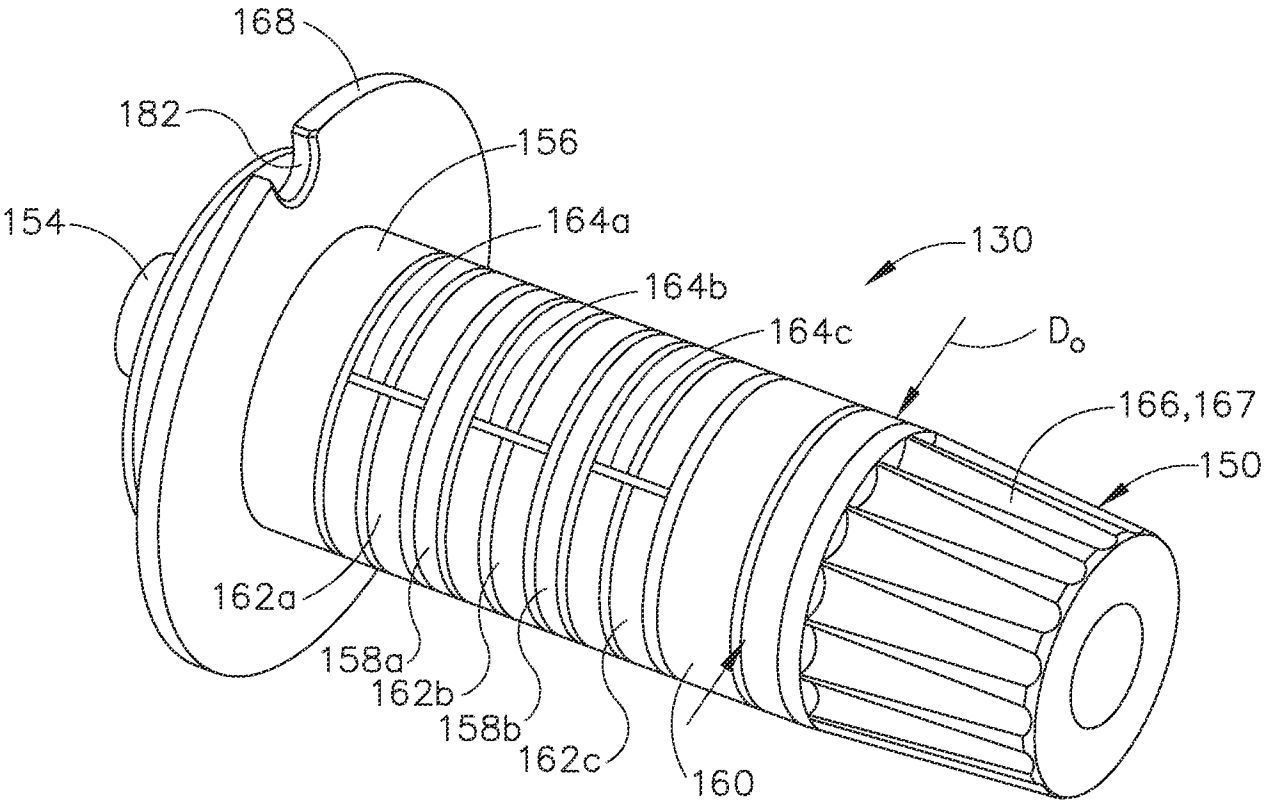
FIG. 5 depicts a perspective view of a wind-up spindle having an adjustment mechanism for varying an outer diameter $D_O$ of the wind-up spindle, in accordance with one embodiment.

With reference to FIGS. 2, 3 and 4, there is shown one embodiment of a reel-to-reel assembly 100 having a supply spindle 110, a supply reel 112 mounted around the supply spindle 110, a ribbon 120, a guide roller 116, a plurality of guides 118, and 119 and a tensioner 122 around which the ribbon is guided, a metering roller 140, a wind-up spindle 130, a wind-up reel 132 mounted around the wind-up spindle 130, and a mounting plate 102 upon which the supply spindle 110, the plurality of guides 118, and 119, the guide roller 116, the tensioner 122, the meter roller 140, and the wind-up spindle 130 are all mounted onto.

Preferably, the reel-to-reel assembly 100 is a cassette assembly which is mounted within a thermal transfer printer, or any printer which uses a ribbon-based system for imprinting an image onto a substrate. However, the reel-to-reel assembly 100 may be a portion of device which uses a reel-to-reel system, such as a movie projector, a tape player, a magnetic tape player, or any other device which uses reels of ribbon or rolls of material mounted onto a rotating spindle.

Mounting plate 102 provides a rigid inner surface 105 upon which to mount many of the components of the reel-to-reel assembly 100. In one embodiment, the mounting plate 102 is made from a metal material, such as steel, having a thickness of between 5 and 15 mm. Preferably, handles 104 are affixed to an outer surface 103 the mounting plate 102 to provide a user with a means for holding and moving the reel-to-reel assembly 100.

The supply spindle 110 includes a fixed central shaft (not shown) which is fixedly connected with the inner surface 105 of the mounting plate 102, and an outer mandrel 111 which is rotatably connected with the fixed central shaft (not shown) preferably via a pair of needle bearings (not shown). The needle bearings (not shown) allowing for the outer mandrel 111 to rotate and spin freely about the fixed central shaft (not shown). Preferably, the supply spindle 110 includes a friction fitting 115, such as a compression spring, on the supply spindle 110 which applies a certain amount of force onto a first cylindrical core 113 of the supply reel 112, in order to secure the first cylindrical core 113 and the supply reel 112 on the supply spindle 110.

With reference to FIGS. 2, 5, 6A, 6B, and 6C, the wind-up spindle 130 includes a fixed central shaft 154 which is fixedly connected with the inner surface 105 of the mounting plate 102, and mounted a distance $D_1$ away from the fixed central shaft (not shown) of the supply spindle 110. Preferably, the distance $D_1$ is at least greater than half a maximum diameter $D_S$ of the supply reel 112. The wind-up spindle 130 also includes an outer mandrel 186 which is rotatably connected with the fixed central shaft 154 preferably via a pair of needle bearings 172, 174. The needle bearings 172, 174 allowing for the outer mandrel 186 to rotate and spin freely about the fixed central shaft 154.

Preferably, the wind-up spindle 130 includes an adjustment mechanism 150 for varying an outer diameter $D_O$ of the wind-up spindle 130 from an initial outer diameter $D_{Oi}$ to a final outer diameter $D_{Of}$ which is larger than the initial outer diameter $D_{Oi}$. Once adjusted, the adjustment mechanism 150 is capable of applying a certain amount of force onto a second cylindrical core 134 of the wind-up reel 132, in order to secure the second cylindrical core 134 and the wind-up reel 132 onto and around the wind-up spindle 130. The adjustment mechanism 150 is able to vary the outer diameter $D_O$ of the wind-up spindle 130 from the initial outer diameter $D_{Oi}$ to the final outer diameter $D_{Of}$ in order to secure an initially empty second cylindrical core 134 of the wind-up reel 132 on the wind-up spindle 130.

Preferably, the first and second cylindrical cores 113, 134 are paper-based cylindrical cores having an inner diameter $D_I$ of approximately 25 mm, ±5 mm. An outer wall of the cylindrical cores 113, 134 is approximately 3 mm, ±2 mm, thick. Preferably, the wind-up reel 132 has an inner diameter $D_I$ which is greater than the initial outer diameter $D_{Oi}$ to allow for the wind-up reel 132 to be mounted onto the wind-up spindle 130. Upon receiving and mounting the wind-up reel 132 onto the wind-up spindle 130, the adjustment mechanism 150 is engaged to vary and enlarge the outer diameter $D_O$ of the wind-up spindle 130 from an initial outer diameter $D_{Oi}$ to a final outer diameter $D_{Of}$.

In this way, by varying and enlarging the outer diameter $D_O$ of the wind-up spindle 130 from an initial outer diameter $D_{Oi}$ to a final outer diameter $D_{Of}$, if the cylindrical core 134 of the wind-up reel 132 collapses onto itself and fuses itself around the wind-up spindle 130, the outer diameter $D_O$ of the wind-up spindle can then be adjusted and varied again to be made smaller, allowing for a collapsed cylindrical core 134 to be more easily removed from the wind-up spindle 130.

With reference to FIG. 3, the supply spindle 110 receives the supply reel 112 having a length of ribbon 120 wrapped around the supply reel 112. Preferably, the ribbon 120 is between 600 and 1000 meters long. The ribbon 120 follows a path P from the supply spindle 110 to the wind-up spindle 130 that wraps partially around guide roller 116 and in between the guide roller 116 and the tear-drop shaped tensioner 122, around a portion of the tensioner 122 and then makes a right angle turn around a portion of first guide 118 and another right angle turn around the second guide 119 to the meter roller 140. The ribbon 120 is wrapped partially around the metering roller 140 and then connected with the second cylindrical core 134 of the wind-up reel 132, which is mounted on the wind-up spindle 130.

Guide roller 116 and metering roller 140 are rotationally connected to and mounted on the inner surface 105 of the mounting plate 102, and metering roller 140 is preferably covered with a padded or rubber-like member to better grip onto and guide ribbon 120. Guide roller 116 preferably includes a low-friction sleeve designed to reduce friction between ribbon 120 and a supporting shaft of guide roller 116. Tensioner 122 is movably mounted on the inner surface 105 of the mounting plate 102, and includes a spring which biases the tensioner 122 in a direction against the ribbon and towards the guide roller 116, as shown in FIG. 3, in order to maintain a certain amount of tension on the ribbon 120 as it moves along the path P. First and second guides 118, 119 around fixedly mounted onto the inner surface 105 of the mounting plate 102, preferably at opposing corners of the mounting plate 102, as shown in FIG. 3. The guides 118, 119 are preferably formed from a rigid material, such as a metal like steel, chrome, aluminum or stainless steel, or a plastic.

Metering roller 140 is connected to a motor, preferably an electric motor, which imparts a rotational movement onto the meter roller 140. Metering roller is rotationally connected with the wind-up spindle 130 in order to impart the rotational movement generated by the motor onto the wind-up spindle 130. Preferably, metering roller 140 is rotationally connected with the wind-up spindle 130 via a gear or set of gears, a belt, a band, or series of belts or bands. In one embodiment, the metering roller 140 is rotationally connected with the wind-up spindle 130 via a round belt 142, preferably made of rubberized material or polyurethane, that goes partially around a first grove formed on the metering roller 140 and partially around a second groove 190 formed on the wind-up spindle 130.

With reference to FIG. 2, in one embodiment, a tension band 114 is wrapped partially around a groove formed in the supply spindle 110, with each end of the tension band 114 fixedly connected with the inner surface 105 of the mounting plate 102 at generally a right angle with respect to each other. The tension band 114 imparts some force onto the supply spindle 110 in order to prevent the supply spindle 110 from unintentionally rotating due to inertia. Preferably, the tension band 114 is connected with a spring 121 at one end and the spring 121 is fixedly connected with the inner surface 105 of the mounting plate 102.

With reference to FIGS. 2 and 3, in one embodiment, the reel-to-reel assembly 100 includes a first catch 106 which engages and is removably coupled with a second catch on the device, such as a thermal transfer printer, in which the reel-to-reel assembly 100 is installed, to allow for the couple with the device and then the removal of the reel-to-reel assembly 100 from the device in which the reel-to-reel assembly 100 is installed. Preferably, the catch 106 is activated by depressing a button 107 found on the outer surface 103 of the mounting plate.

Figure 6B:
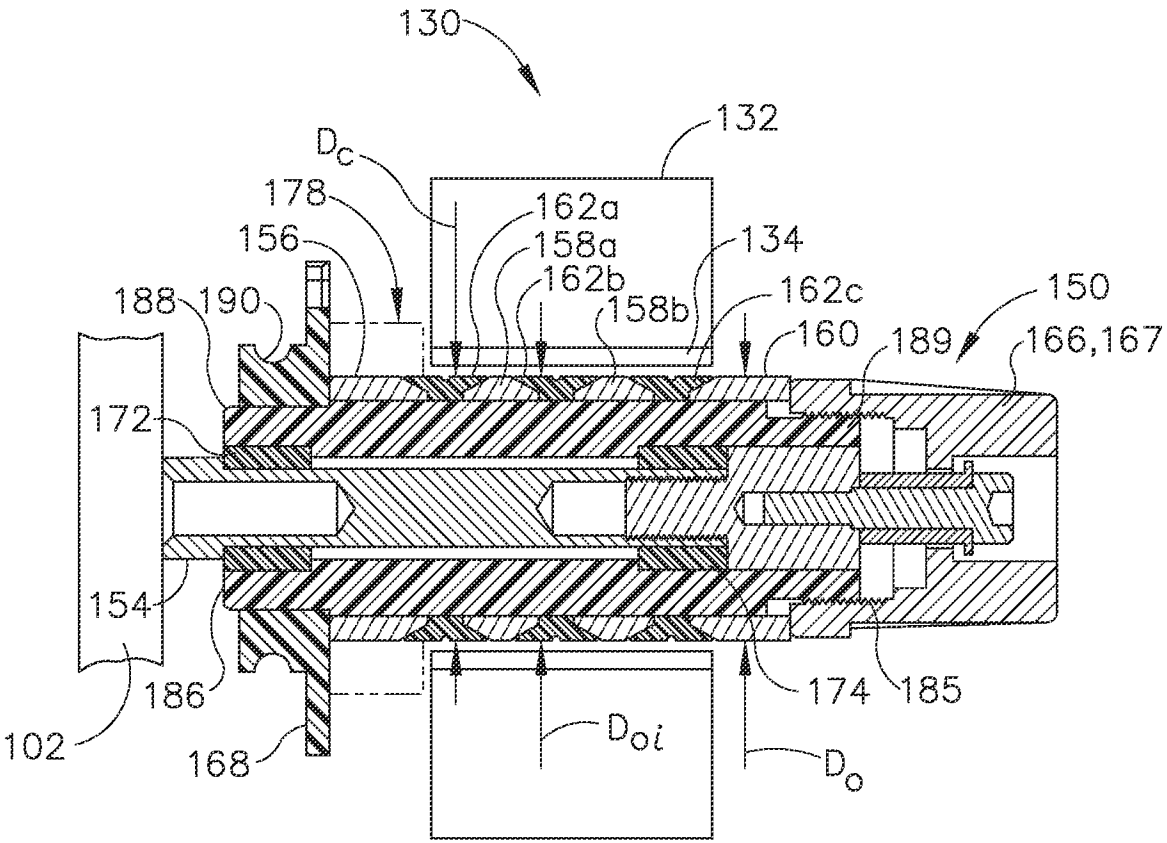
FIG. 6B depicts a cross-sectional side view of the wind-up spindle shown in FIG. 5 taken along line A-A and in a first position having an initial outer diameter $D_{Oi}$, in accordance with one embodiment.
Figure 6A:
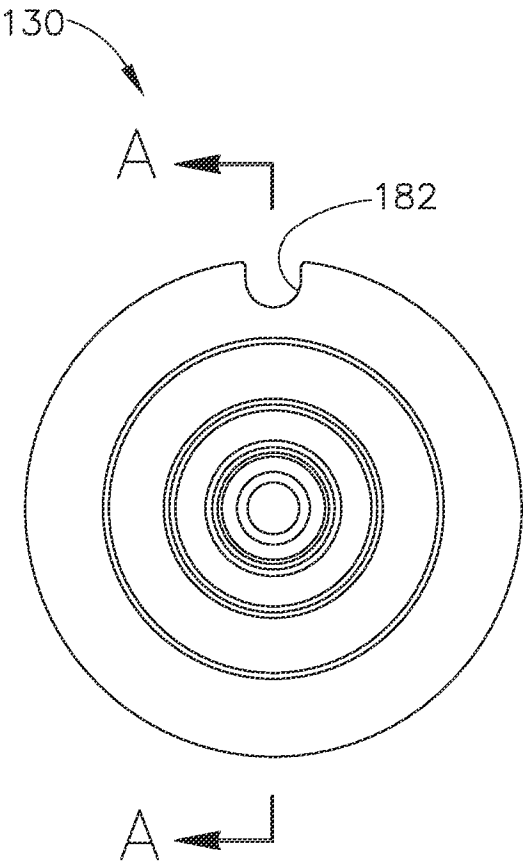
FIG. 6A depicts a top view of the wind-up spindle shown in FIG. 5, in accordance with one embodiment.
Figure 6C:
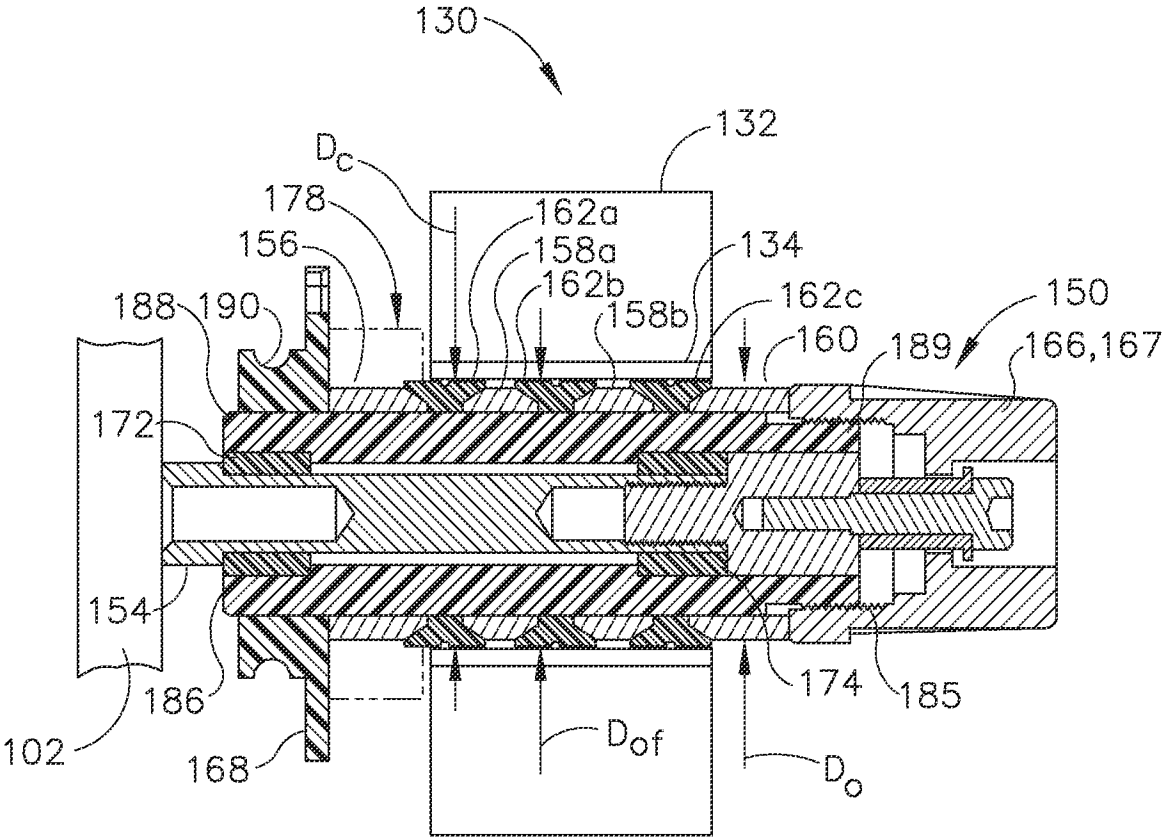
FIG. 6C depicts a cross-sectional side view of the wind-up spindle shown in FIG. 5 taken along line A-A and in a second position having a final outer diameter $D_{Of}$, in accordance with one embodiment.

With reference to FIGS. 6A, 6B, and 6C, in one embodiment, the adjustment mechanism 150 includes a set of expansion rings 162*a*, 162*b*, and 162*c* each wrapped around the fixed central shaft 154 of the wind-up spindle 130 and each preferably forming an expansion slit 164*a*, 164*b*, 164*c*, respectively, and an adjustment member 166 which may be engaged to provide axial pressure onto the expansion rings 162*a*, 162*b*, and 162*c*, causing the expansion rings 162*a*, 162*b*, and 162*c* to expand in diameter. The expansion rings 162*a*, 162*b*, and 162*c* can be knurled to grip plastic cores. The expansion slits 164*a*, 164*b*, 164 allow for the expansion ring 162*a*, 162*b*, and 162*c* to expand when axial pressure is applied onto the expansion rings 162*a*, 162*b*, and 162*c*. The expansion rings 162*a*, 162*b*, and 162*c* each have a diameter $D_C$ which is equal to the outer diameter $D_O$ of the wind-up spindle 130. So as the diameter $D_C$ of the expansion rings 162*a*, 162*b*, and 162*c* is increased, the effective outer diameter $D_O$ of the wind-up spindle 130 also increases by the same amount.

The adjustment member 166 is any member which can be engaged to provide axial pressure onto the expansion rings 162*a*, 162*b*, and 162*c*, such as a threaded member, a threaded lock, an internally threaded knob, a screw and washer, or a lever having a cam attached at one end of the lever for providing axial pressure onto the expansion rings 162*a*, 162*b*, and 162*c*. With reference to FIGS. 5, 6A, 6B, and 6C, in one embodiment, the adjustment member 166 is an internally threaded knob 167 which is connected with and engages an externally threaded portion 185 of the outer mandrel 186. As the threaded knob 167 is rotated clockwise, the threaded knob 167 either directly or indirectly presses against the expansion rings 162*a*, 162*b*, and 162*c*, and provides axial pressure onto the expansion rings 162*a*, 162*b*, and 162*c*, causing the expansion rings 162*a*, 162*b*, and 162*c* to expand in diameter.

In one embodiment, the adjustment mechanism 150 includes an inner ring 156 adjacent a reel retainer flange 168 surrounding and connected with the outer mandrel 186 at a first end 188 adjacent the mounting plate 102. The reel retainer flange 168 prevents the wind-up reel 132 from touching the mounting plate 102 when mounted onto the wind-up spindle 130. Preferably, the second groove 190 is formed on a lower portion of the reel retainer flange 168, as shown in FIG. 6B. The inner ring 156 surrounds the outer mandrel 186 and the fixed central shaft 154 and abuts the expansion ring 162*a* on a first side.

Figure 7:
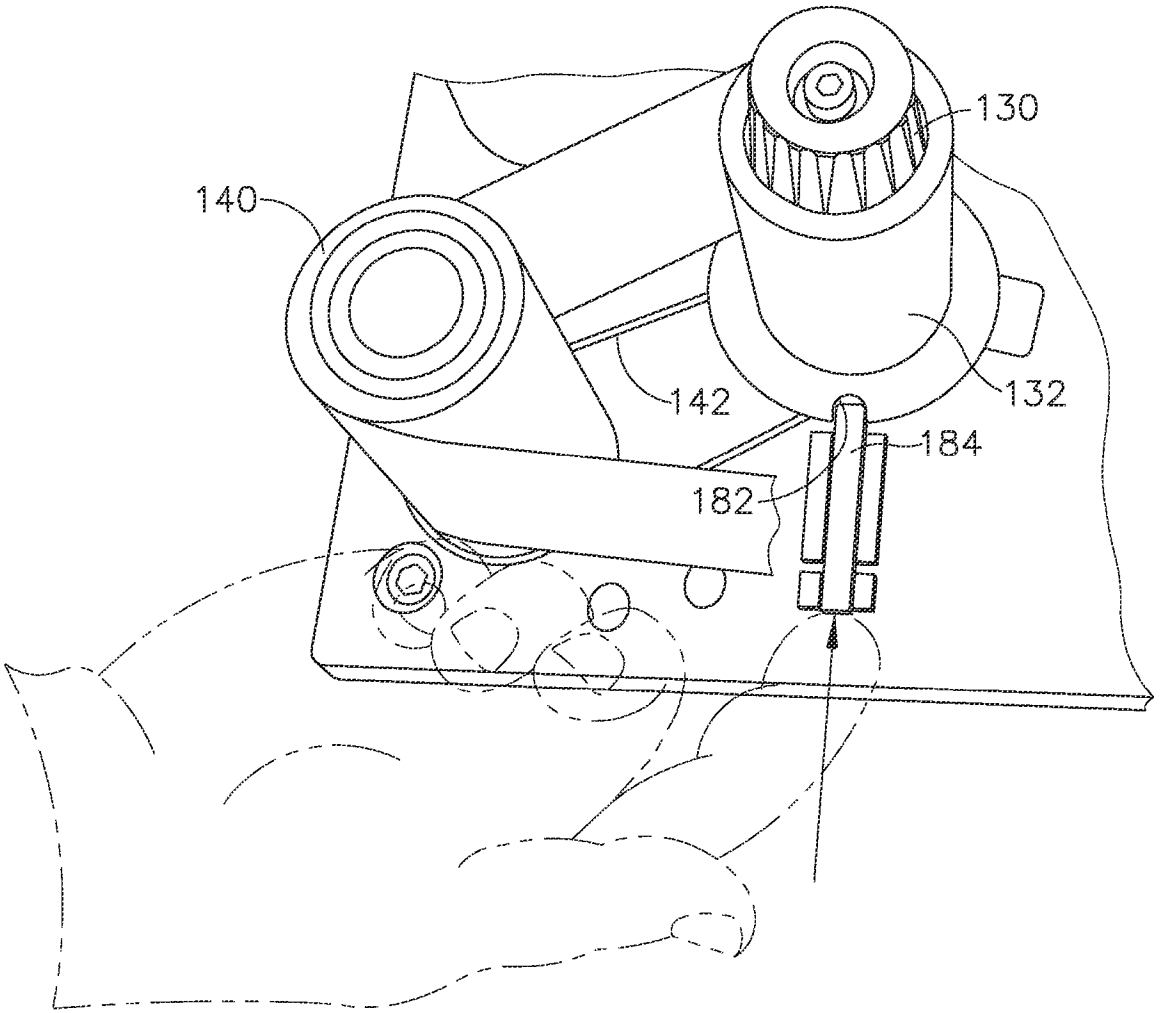
FIG. 7 depicts an enlarged top view of the cassette assembly shown in FIG. 3, in accordance with one embodiment.

With reference to FIGS. 3, 6A, and 7, preferably, the reel retainer flange 168 forms a notch 182 along an outer edge. The notch 182 engages a lock/catch mechanism 184 which extends into the notch 182, as shown in FIG. 7, and prevents the wind-up spindle 130 from rotating, allowing for easier engagement of the adjustment mechanism 150.

With reference to FIG. 6B, in one embodiment, the wind-up spindle 130 includes a spacer ring 178 wrapped around the outer mandrel 186, adjacent the reel retainer flange 168 and between the reel retainer flange 168 and the wind-up reel 132. The spacer ring 178 is used to align, and preferably, center the ribbon 120 with respect to a print head (not shown) within a thermal transfer printer.

In one embodiment, the adjustment mechanism 150 includes an outer ring 160 adjacent the adjustment member 166, surrounding and connected with the outer mandrel 186 at a second end 189 of the outer mandrel 186 opposed to the first end 188. The outer ring 160 surrounds the outer mandrel 186 and the fixed central shaft 154 and abuts the expansion ring 162*c* on a first side.

Preferably, the inner ring 156 forms a wedge-shaped edge on the side which abuts the expansion ring 162*a*, and the outer ring 160 also forms a wedge-shaped edge on the side which abuts the expansion ring 162*c*.

In one embodiment, the adjustment mechanism 150 also includes a first intermediate ring 158*a* located in between the first and second expansion rings 162*a* and 162*b*, and a second intermediate ring 158*b* located in between the second and third expansion rings 162*b* and 162*c*. Preferably, the intermediate rings 158*a* and 158*b* form wedge shaped edges on each side which abuts an expansion ring 162*a*, 162*b*, and 162*c*. The wedge-shaped edges of the inner and outer rings 156 and 160 and the intermediate rings 158*a* and 158*b*, tend to drive the expansion rings 162*a*, 162*b*, and 162*c* up and away from an outer surface of the outer mandrel 186, increasing the diameters of the expansion rings 162*a*, 162*b*, and 162*c*, as pressure is applied directly to the outer ring 160, and indirectly to the remaining rings 162*a*, 162*b*, 162*c*, 158*a*, 158*b*, and 156, from the adjustment member 166.

Preferably the expansion rings 162*a*, 162*b*, and 162*c* have a wedge shaped cross-section, as shown in FIGS. 6B and 6C, so to better engage the wedge-shaped edges of the inner and outer rings 156 and 160 and the intermediate rings 158*a* and 158*b*.

In operation, the supply spindle 110 receives the supply reel 112 having a length of ribbon 120 wrapped around the supply reel 112. The ribbon 120 is wound around and between the guide roller 116, the tensioner 122, the first and second guides 118, 119 and the metering roller 140 along path P to the wind-up spindle 130. The wind-up reel 132, and specifically the cylindrical core 134 is the mounted around and received by the wind-up spindle 130 having initial an outer diameter $D_{Oi}$ which is less than the inner diameter $D_I$ of the cylindrical core 134.

Then the adjustment mechanism 150 is engaged so to vary the outer diameter $D_O$ of the wind-up spindle 130 from the initial outer diameter $D_{Oi}$ to a final outer diameter $D_{Of}$ which is larger than the initial outer diameter $D_{Oi}$. In one embodiment, the adjustment mechanism 150 is engaged by engaging adjustment member 166 to provide axial pressure onto the expansion rings 162*a*, 162*b*, and 162*c*, causing the expansion rings 162*a*, 162*b*, and 162*c* to expand in diameter, and therefore causing the outer diameter $D_O$ of the wind-up spindle 130 to vary from the initial outer diameter $D_{Oi}$ to a final outer diameter $D_{Of}$ which is larger than the initial outer diameter $D_{Oi}$. Upon engaging the adjustment mechanism 150 and increasing the outer diameter $D_O$ of the wind-up spindle 130 to a final outer diameter $D_{Of}$, the ribbon 120 is connected with the cylindrical core 134, the motor engaging the metering roller 140 is activated, and the wind-up spindle 130 is rotated, wrapping the ribbon 120 around the cylindrical core 134.

When the ribbon 120 has finished wrapped around the cylindrical core 134, the adjustment mechanism 150 is then engaged again so to vary the outer diameter $D_O$ of the wind-up spindle 130 from the final outer diameter $D_{Of}$ to an adjusted outer diameter $D_{Oa}$ which is smaller than the final outer diameter $D_{Of}$. In one embodiment, the adjustment mechanism 150 is engaged again by engaging an adjustment member 166 to release axial pressure provided onto the expansion rings 162*a*, 162*b*, and 162*c*, causing the expansion rings 162*a*, 162*b*, and 162*c* to contract in diameter, and therefore causing the outer diameter $D_O$ of the wind-up spindle 130 to vary from the final outer diameter $D_{Of}$ to an adjusted outer diameter $D_{Oa}$ which is smaller than the final outer diameter $D_{Of}$, and which allows for removal of the cylindrical core 134 from the wind-up spindle 130.

Upon engaged the adjustment mechanism 150 again so as to vary the outer diameter $D_O$ of the wind-up spindle 130 from the final outer diameter $D_{Of}$ to an adjusted outer diameter $D_{Oa}$, the cylindrical core 134 and the wind-up reel 132 are removed from the wind-up spindle 130, and possibly discarded.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A reel-to-reel assembly, comprising:

a supply spindle which receives a supply reel having a length of ribbon wrapped around the supply reel; and a wind-up spindle which receives an initially empty wind-up reel and the wind-up spindle having an initial outer diameter $D_{Oi}$, a final outer diameter $D_{Of}$ which is larger than the initial outer diameter $D_{Oi}$, a first end and a second end opposite the first end, wherein the wind-up spindle includes an adjustment mechanism which includes an adjustment member positioned adjacent the first end of the wind-up spindle and moveable toward the second end of the wind-up spindle to vary the outer diameter $D_O$ of the wind-up spindle from the initial outer diameter $D_{Oi}$ to the final outer diameter $D_{Of}$;

wherein the adjustment mechanism includes an expansion ring forming a slit and wrapped around a central shaft of the wind-up spindle, wherein the adjustment member provides axial pressure onto the expansion ring as the adjustment member moves toward the second end of the wind-up spindle, causing the expansion ring to expand in diameter; and wherein the adjustment member includes a threaded member for providing axial pressure onto the expansion ring.

2. The assembly of claim 1, wherein the wind-up reel has an inner diameter $D_I$ which is greater than the initial outer diameter $D_{Oi}$ of the wind-up spindle.

3. The assembly of claim 1, wherein the reel-to-reel assembly is a cassette assembly.

4. The assembly of claim 1, wherein the central shaft is connected with a bearing which allows the central shaft to rotate axially.

5. The assembly of claim 1, wherein the expansion ring has a diameter Dc which is equal to the outer diameter $D_O$ of the wind-up spindle.

6. The spindle of claim 1, wherein the threaded member increases axial pressure on the expansion ring when moved toward the second end and decreases axial pressure on the expansion ring when moved toward the first end.

7. A spindle comprising:

a bearing;

a central shaft connected with the bearing and including a first end and a second end, wherein the bearing allows the central shaft to rotate axially; and an adjustment mechanism connected with the central shaft, wherein the adjustment mechanism varies an outer diameter $D_O$ of the spindle from an initial outer diameter $D_{Oi}$ to a final outer diameter $D_{Of}$ which is larger than the initial outer diameter $D_{Oi}$, wherein the adjustment mechanism includes an adjustment member positioned adjacent the first end of the central shaft and moveable toward the second end of the central shaft to vary the outer diameter $D_O$ of the spindle from the initial outer diameter $D_{Oi}$ to the final outer diameter $D_{Of}$;

wherein the adjustment mechanism includes an expansion ring forming a slit and wrapped around the central shaft and the adjustment member provides axial pressure onto the expansion ring when the adjustment member moves toward the second end, causing the expansion ring to expand in diameter; and wherein the adjustment mechanism includes an inner ring surrounding the central shaft and abutting the expansion ring on a first side, an outer ring surrounding the central shaft and abutting the expansion ring on a second side opposed to the first side, wherein the inner ring abuts a reel retainer flange and the outer ring abuts the adjustment member so that the adjustment member is able to apply axial pressure directly to the outer ring and indirectly to the expansion ring.

8. The spindle of claim 7, further comprising a reel having a cylindrical core with an inner diameter $D_I$, wherein the cylindrical core is received by and mounted around the spindle, and wherein the spindle has the initial outer diameter $D_{Oi}$ when receiving the cylindrical core, and wherein the inner diameter $D_I$ is greater than the initial outer diameter $D_{Oi}$.

9. The spindle of claim 7, wherein the expansion ring has a diameter Dc which is equal to the outer diameter $D_O$ of the wind-up spindle.

10. The spindle of claim 7, wherein the adjustment member includes a threaded member for providing axial pressure onto the expansion ring.

11. A spindle for a reel-to-reel assembly, the spindle comprising:

a central shaft which is fixedly connected with a mounting plate;

an outer mandrel which is rotatably connected with the central shaft; and an adjustment mechanism connected with the outer mandrel, wherein the adjustment mechanism varies an outer diameter $D_O$ of the spindle from an initial outer diameter $D_{Oi}$ to a final outer diameter $D_{Of}$ which is larger than the initial outer diameter $D_{Oi}$;

wherein the adjustment mechanism includes an expansion ring forming a slit and wrapped around the outer mandrel and an adjustment member which provides axial pressure onto the expansion ring, causing the expansion ring to expand in diameter; and wherein the adjustment mechanism includes an inner ring surrounding the outer mandrel and abutting the expansion ring on a first side, an outer ring surrounding the outer mandrel and abutting the expansion ring on a second side opposed to the first side, wherein the inner ring abuts a reel retainer flange and the outer ring abuts the adjustment member so that the adjustment member is able to apply axial pressure directly to the outer ring and indirectly to the expansion ring.

12. The spindle of claim 11, wherein the adjustment member includes a threaded member for providing axial pressure onto the expansion ring.

13. The spindle of claim 11 further comprising a bearing located in between the central shaft and the outer mandrel.

14. The spindle of claim 11, wherein the adjustment member increases axial pressure on the expansion ring when moved toward the mounting plate and decreases axial pressure on the expansion ring when moved away from the mounting plate.

* * * * *